US005485167A

United States Patent [19]

Wong et al.

[11] Patent Number: 5,485,167

[45] Date of Patent: Jan. 16, 1996

[54] MULTI-FREQUENCY BAND PHASED-ARRAY ANTENNA USING MULTIPLE LAYERED DIPOLE ARRAYS

[75] Inventors: Nam S. Wong, Fullerton; Kuan M. Lee, Brea; Raymond Tang, Fullerton, all of Calif.

[73] Assignee: Hughes Aircraft Company, Los Angeles, Calif.

[21] Appl. No.: 183,205

[22] Filed: Jan. 18, 1994

Related U.S. Application Data

[63] Continuation of Ser. No. 971,712, Nov. 4, 1992, abandoned, which is a continuation of Ser. No. 447,973, Dec. 8, 1989, abandoned.

[51] Int. Cl.[6] ..... H01Q 15/02; H01Q 5/02; H01Q 21/12

[52] U.S. Cl. ..... 343/753; 343/754; 343/815; 343/834

[58] Field of Search ..... 343/725, 729, 343/754, 812, 814–817, 820, 853, 834, 909, 753; H01Q 5/00–5/02, 21/26, 21/00, 21/28, 21/24, 21/12, 15/02, 15/12

[56] References Cited

U.S. PATENT DOCUMENTS

| | | | |
|---|---|---|---|
| 3,681,769 | 8/1972 | Perrotti et al. | 343/814 |
| 3,747,111 | 7/1973 | Fletcher et al. | 343/729 |
| 3,771,158 | 11/1973 | Hatcher | 343/771 |
| 4,015,266 | 3/1977 | Borowick | 343/815 |
| 4,081,803 | 3/1978 | Dempsey | 343/816 |
| 4,097,868 | 6/1978 | Borowick | 343/834 |
| 4,348,677 | 9/1982 | Salmond | 343/729 |
| 4,864,314 | 9/1989 | Bond | 343/725 |
| 4,870,426 | 9/1989 | Lamberty et al. | 343/727 |
| 4,926,189 | 5/1990 | Zaghloul et al. | 343/909 |

FOREIGN PATENT DOCUMENTS

| | | | |
|---|---|---|---|
| 45254 | 2/1982 | European Pat. Off. | 343/817 |
| 582007 | 8/1933 | Germany | 343/817 |

*Primary Examiner*—Michael C. Wimer
*Attorney, Agent, or Firm*—W. K. Denson-Low

[57] ABSTRACT

A multiple layer dipole array that provides for a multi-frequency band phased array antenna. Several layers of dipole pair arrays, each tuned to a different frequency band, are stacked relative to each other along the transmission/reception direction. The highest frequency array is in front of the next lowest frequency array and so forth. Due to the frequency selective property of the arrays, incident high frequency signals are completely absorbed by the highest frequency array. In regard to incident low frequency signals, the insertion loss due to higher frequency arrays is small resulting in good performance of the lower frequency arrays. The multi-frequency band phased array antenna may use active or driven dipole pairs, or parasitic elements that form the multiple layer dipoles. The multiple layer dipole array of the present invention may employ corporate feed circuit boards and a corporate feed power divider, using strip transmission line circuits, for example. The multiple layer dipole phased array of the present invention may also employ a feed-through lens arrangement to simplify the feed network.

9 Claims, 4 Drawing Sheets

Fig. 5.
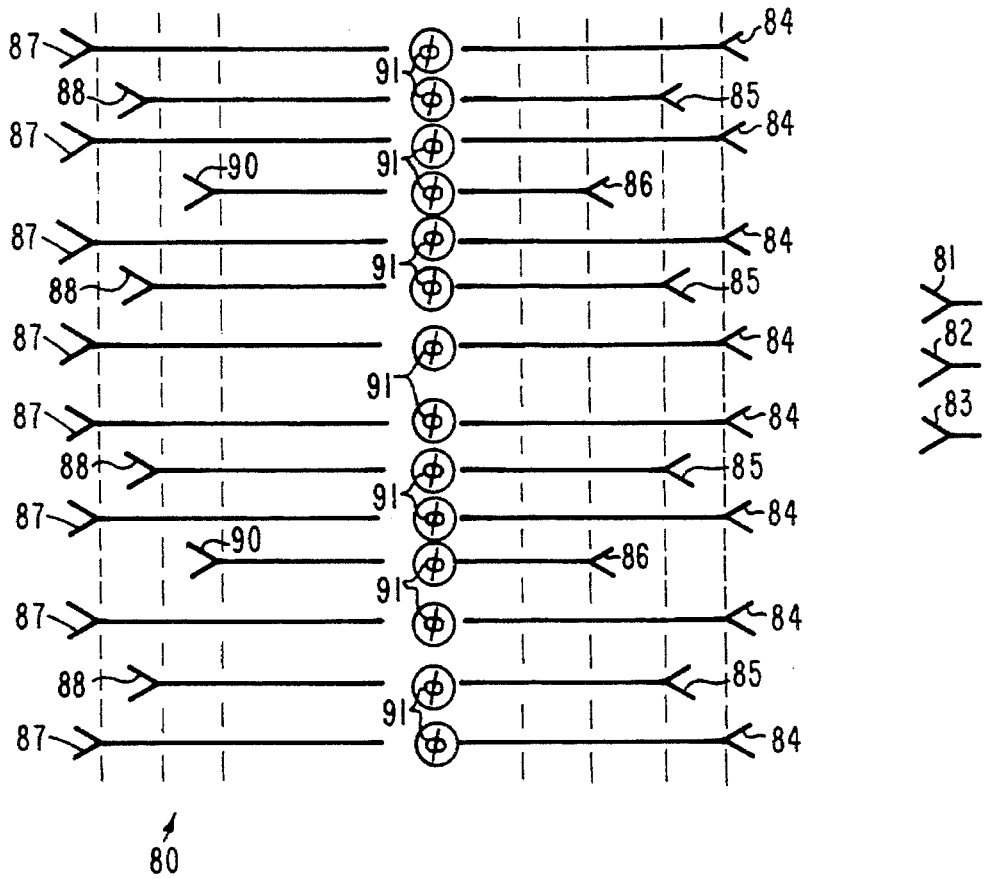
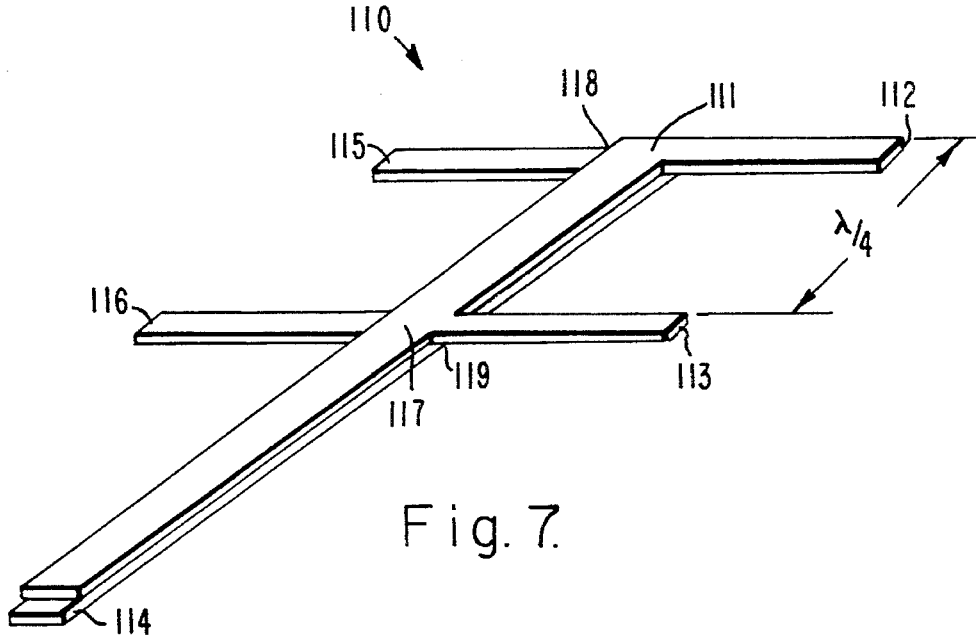
Fig. 7.

MULTI-FREQUENCY BAND PHASED-ARRAY ANTENNA USING MULTIPLE LAYERED DIPOLE ARRAYS

This is a continuation of application Ser. No. 971,712, filed Nov. 4, 1992, abandoned, which is a continuation, of application Ser. No. 447,973, filed Dec. 8, 1989, abandoned.

BACKGROUND

The present invention relates to a phased-array antenna, and more particularly to an array of stacked layers of dipole antennas, each layer tuned to a different frequency band to provide a phased array antenna for operation in different frequency bands.

The present invention utilizes multiple layer dipole arrays for separated frequency bands to achieve a multi-frequency band phased array antenna. An array of stacked dipoles achieves the performance in an operating band similar to the performance of a dipole array located over a ground plane. At the same time, the array of stacked dipoles is essentially transparent at lower frequency operations. Therefore, several layers of stacked dipoles each tuned to a different frequency band may be stacked to achieve desired multi-frequency multi-function operation.

The multi-frequency band antenna of the present invention may combine several radar operations using a common antenna aperture and has important applications in shipboard radars or airborne radars. The antenna of the present invention is compact and light weight and therefore offers excellent mobility. It has applications in the field of ground-based, mobile tactical radar systems. The capability of the radar is enhanced by using a lower frequency such as L-band for searching and a higher frequency such as C-Band or X-Band for tracking to take advantage of the target frequency response.

The arrays of the present invention may be used for surveillance radar, searching, tracking and communication simultaneously. Due to the frequency selective property of these arrays, the high frequency incident signal, is completely absorbed by the high frequency dipole array. This results in good isolation between the high frequency band and the low frequency band. For the low frequency signal, the insertion loss due to the high frequency array is small and the performance of the low frequency array can therefore be maintained. Separated feed boards are used for each frequency band. The feed boards are arranged in an interleaved fashion and result in a very compact packaging arrangement. Simultaneous multi-function operations may be achieved by using separated feeds. Band selection is also flexible. Furthermore, the electronic failure of one of the elements does not affect another element.

A multi-frequency array antenna consisting of interlaced waveguide radiating elements with operating frequencies in L, S and C-Bands has been described by J. E. Boyns and J. H. Provencher in "Experimental Results of a Multi-Frequency Array Antenna", IEEE Trans. on Antennas and Propagation, Jan. 1972, p. 106–107). The presence of the low frequency elements generates more significant grating lobes. Also, this prior an array does not have the frequency selective property of dipole pair arrays. Therefore, the high frequency incident signal will be coupled into the low frequency array and the isolation is poor.

Accordingly, it is a feature of the present invention to provide a phased-array antenna that operates in different frequency bands. Another feature of the invention is the provision of a multi-frequency band phased array antenna that has good isolation between the high frequency band and the low frequency band. Yet another feature of the present invention is to provide a phased array antenna for operation in different frequency bands that is compact and light in weight.

SUMMARY OF THE INVENTION

In accordance with the present invention, there is provided a multiple layer dipole array for a multi-frequency band phased array antenna. Several layers of dipole pair arrays, each tuned to a different frequency band, are stacked relative to each the other. Due to the frequency selective property of the arrays, the incident high frequency signal is completely absorbed by the high frequency array. In regard to the incident low frequency signal, the insertion loss due to the high frequency array is small resulting in good performance of the low frequency array.

In one embodiment of the invention, the multi-frequency band phased array antenna is formed of active or driven dipole pairs. In another embodiment, the array employs parasitic elements to form the multiple layer dipoles. This has the advantage of simplifying the feed packaging. The multiple layer dipole array of the present invention may employ corporate feed circuit boards and a corporate feed power divider, using strip transmission line circuits, for example.

A feedthrough lens embodiment employs pick-up arrays and re-radiating arrays made up of multiple dipole layers tuned to frequencies $f_1$, $f_2$ and $f_3$. Phase shifters and controllers for each frequency band may be inserted between the pick-up arrays and the re-radiating arrays for scanning the beams.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIG. 5 illustrates schematically an embodiment of a feedthrough lens antenna employing the principles of the present invention;

FIG. 7 shows a perspective view of a dipole pair employing strip transmission line feeds for the radiating elements.

DETAILED DESCRIPTION

Figures 1, 2:
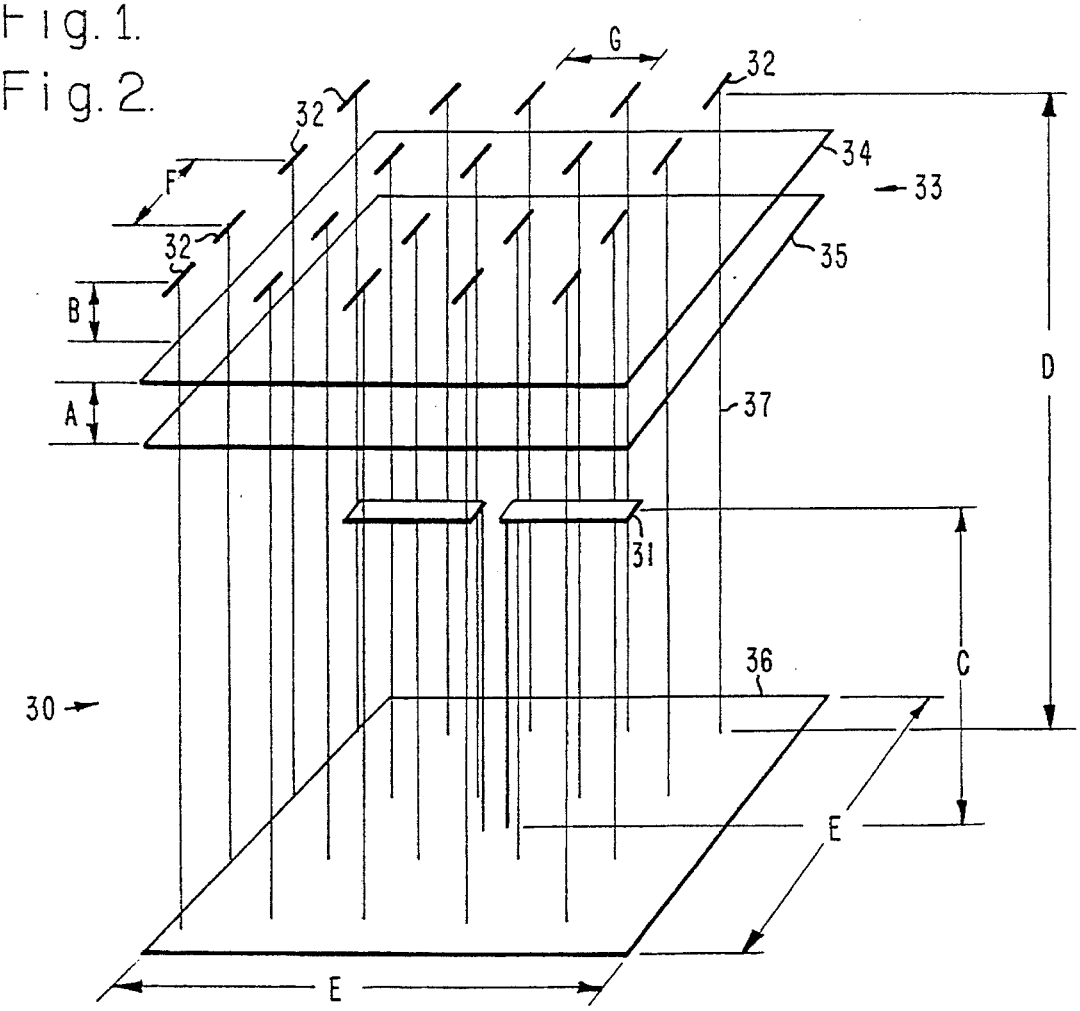
FIG. 1 illustrates in schematic form the geometric configuration of a dual-band antenna constructed in ace&dance with the invention.
FIG. 2 shows a perspective view of one unit cell of a dual-band antenna array of large aperture.

Referring now to FIG. 1 of the drawings there is illustrated in schematic form the geometric configuration of a dual-band antenna 10, constructed in accordance with the invention. In this embodiment a high-band dipole array 11 is positioned in front of a low-band dipole array 12. A high-band ground screen 13 is disposed between the high-band dipole array 11 and the low-band dipole array 12. A low-band ground plane 14 is disposed between the low-band dipole array 12 and an antenna feed arrangement 15.

In a dual-band radar system, typically the high-band dipole array 11 operates in the C-band frequency range, and the low-band dipole array 12 operates in the L-band frequency range, with the frequency ratio between the high-band and the low-band being on the order of 5:1. In the present embodiment, the high-band dipole array 11 operates at 5 GHz+/–10%, and the low-band dipole array 12 operates at 0.9 GHz+/–10%. The low-frequency band is used in the search function, and the high frequency band is used in the track function to take advantage of the characteristics of each frequency band.

The high-band ground screen 13 comprises a plurality of parallel wires 16 disposed in a grid in a direction parallel to a plurality of elements 17 that comprise the high-band dipole array 11. A plurality of elements 18 that comprise the low-band dipole array 12 are arranged to be transverse to the high-band elements 17 so that the low-band dipole array 12 is cross-polarized with respect to the high-band dipole array 11.

The high-band elements 17 thus are provided with a good ground reflection with very little energy leak through the ground screen 13. On the other hand, because the low-band elements 18 are in a cross-polarized direction with respect to the grid of parallel wires 16, the low-band energy passes through the high-band ground screen 13 with very little attenuation.

Similarly, the low-band ground plane 14 is comprised of a plurality of parallel wires 21 disposed in a grid in a direction parallel to the plurality of elements 18 that comprise the low-band dipole array 12. The antenna feed arrangement 15 comprises low-band terminals 22 connected by low-band feed lines 23 to the low-band dipole array 12, and high-band terminals 24 connected by high-band feed lines 20 to the high-band array 11.

High-band and low-band coupling is small between high-band and low-band elements 17, 18 because they are cross-polarized. What little coupling exists is largely due to coupling between the high-band feed lines 20 and the low-band elements 18. By proper selection of the length of the high-band feed lines 20, the induced currents can be reduced and the coupling minimized. At the frequencies employed in the present embodiment of a dual-band antenna 10, the length should be on the order of 4.5 to 6.0 inches, which allows room for the ground screen 13. In the present embodiment, a length of 5.5 inches for the high-band feed lines 20 has been found suitable. The diameter of the feed lines 20 has been found to be a less important parameter.

Referring now to FIG. 2 of the drawings, there is shown a perspective view of one unit cell 30 of a dual-band antenna array measuring substantially 4.69 meters (184.7 inches) per side of the antenna aperture. The complete antenna array comprises an array of 30×30 such unit cells 30. Each cell 30 comprises one L-band dipole 31 and 20 C-band dipoles 32. This provides an antenna aperture of substantially 22 square meters containing 900 L-band dipoles 31 and 1800 C-band dipoles 32.

As is shown in FIG. 2, this embodiment of the dual-band antenna array includes a two-layer, high-band ground screen 33. An upper screen 34 is spaced away from a lower screen 35 by a spacing A of 0.59 inches, which is ¼ wavelength at 5.0 GHz. This layer-to-layer spacing A provides a good ground reflection for the C-band dipoles 32 and low attenuation for the L-band dipoles 31. The C-band dipoles 32 are located at a height B of 0.472 inches above the upper screen 34 of the ground plane 33.

A low-band ground plane 36 is placed a distance C of 2.62 inches below the L-band dipole 31. The C-band dipoles 32 are spaced a distance D of 5.50 inches above the low-band ground plane 36, and accordingly, the C-band feed cables 37 are also 5.50 inches long.

Since the aperture of the dual-band antenna is 184.7 inches by 184.7 inches, the unit cell 30 of the L-band dipole 31 has a length E of 6.1567 inches on each side. The 20 C-band dipoles 32 are cross-polarized and arranged in a regular pattern with four dipoles 32 along one side of unit cell 30, and five dipoles 32 along the other side. Thus, the C-band array has a unit cell dimension F of 1.593 inches in the E-plane of the C-band dipole 32, and a dimension G of 1.231 inches in the H-plane of the C-band dipole 32.

The aperture match of the dual-band antenna is dependent on the dipole dimensions and the element spacing. The radiation impedance of the dual-band antenna is found to be more dependent on dipole length than on dipole width.

In the present embodiment, the L-band dipole 31 has a length of 5.60 inches, a width of 0.66 inches, and a height C above the ground plane 36 of 2.62 inches. In terms of the free space wavelength at a frequency of 0.96 Ghz, the length is 0.47 wavelength, the width is 0.05 wavelength, and the height C is 0.02 wavelength. The lattice spacing is 0.47×0.47 wavelength, and there is no grating lobe in the visible space for frequencies from 0.85 GHz to 0.95 GHz.

In the present embodiment, the C-band dipoles 32 have a length of 1.20 inches, a width of 0.141 inches, and a height B above the ground plane 33 of 0.472 inches. In terms of the wavelength at a frequency of 5.0 GHz, the dipole length is 0.5 wavelength, the width is 0.06 wavelength, and the height B is 0.2 wavelength. The element spacing is 0.652 wavelength in the E-plane, and 0.5215 wavelength in the H-plane. No grating lobes occur within a scan range of+/–20 degrees in the E-plane, and+/–45 degrees in the H-plane for frequencies from 0.475 GHz to 5.25 GHz.

Figure 3:
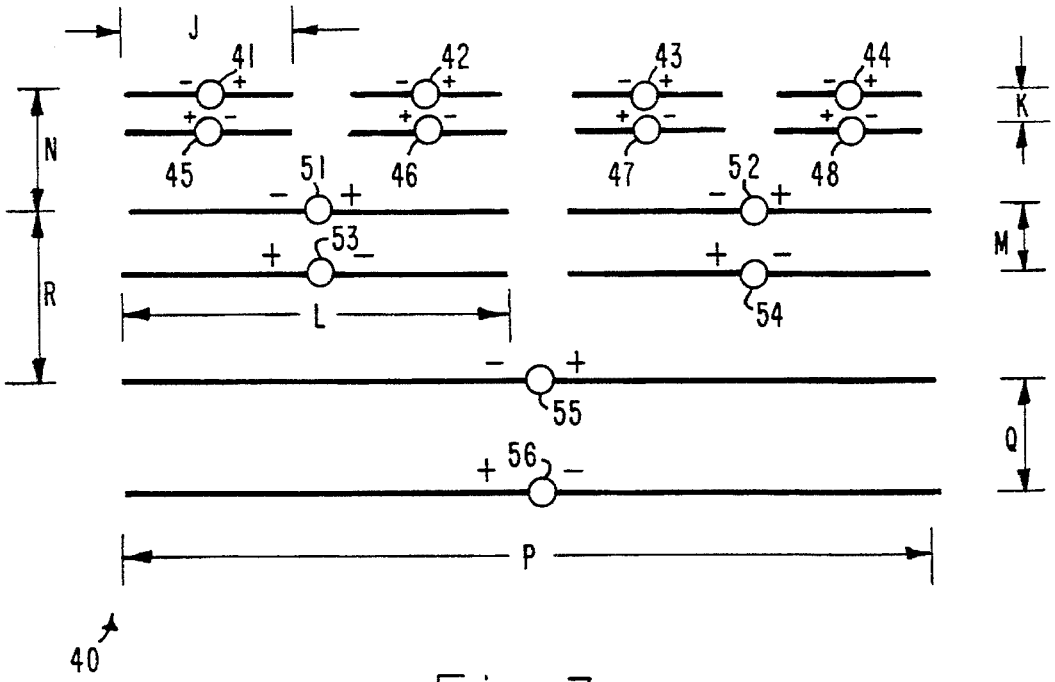
FIG. 3 illustrates in schematic form a generalized embodiment of an antenna having several layers of dipole pair arrays, each tuned to a different frequency band.

Referring now to FIG. 3, there is shown a more generalized embodiment of a multi-band antenna 40 having several layers of dipole pair arrays each tuned to a different frequency band. Whereas the embodiments of the invention illustrated in FIGS. 1 and 2 were dual-band antennas, FIG. 3 shows an antenna 40 for operation in three bands: C-band, S-band, and L-band. The antenna 40 shown in FIG. 3 represents a unit cell comprised of dipole pairs.

There are provided eight C-band dipoles 41–48 arranged as four sets of dipole pairs; dipole pair 41, 45, dipole pair 42, 46, dipole pair 43, 47 and dipole pair 44, 48. Each of the dipoles 41–48 has a dimension J of ½ wavelength at the operating frequency. The dipole pairs 41, 45; 42, 46; 43, 47 and 44, 48 are spaced apart by a dimension K. All of the dipoles 41–48 are driven elements, and the dipoles of each pair are driven 90 degrees out of phase, as illustrated by the plus and minus symbols in FIG. 3. In a manner of speaking, the lower set of dipoles 45, 46, 47, 48 of the embodiment of FIG. 3 takes the place of the ground plane 13, 33 in the embodiments of FIGS. 1 and 2. The separation distance K is ¼ wavelength so that the energy from each dipole pair combines in-phase in the forward direction. In accordance with the invention, it has been found that an array of dipole pairs achieves substantially the same performance in an operating band as a dipole array operating over a ground plane. Furthermore, the array of dipole pairs is essentially transparent to lower frequency operations.

The next layer below the C-band array in this multiple layer multi-band antenna 40 comprises four S-band dipoles 51, 52, 53, 54 arranged as two dipole pairs; dipole pair 51, 53 and dipole pair 52, 54. The S-band dipoles 51,52, 53, 54 have a dimension L which is ½ wavelength at the operating frequency, and dipole pairs 51, 53 and 52, 54 are spaced apart by dimension M. Each S-band dipole 51, 52, 53, 54 is a driven element, and the dipoles of each pair are driven 90 degrees out of phase as illustrated by the plus and minus symbols. The separation distance M is ¼ wavelength so that the energy from each dipole pair combines in-phase in the forward direction. The S-band array is spaced away from the C-band array by a dimension N.

Below the C-band array, the next layer comprises two L-band dipoles 55, 56 arranged as a dipole pair. Again, the length P of the dipoles 55, 56 is ½ wavelength at the operating frequency, and the separation Q is ¼ wavelength. The L-band array is spaced away from the S-band array by a dimension R. These separations N, R between the arrays for different bands may be adjusted to provide optimum performance.

Figure 4:
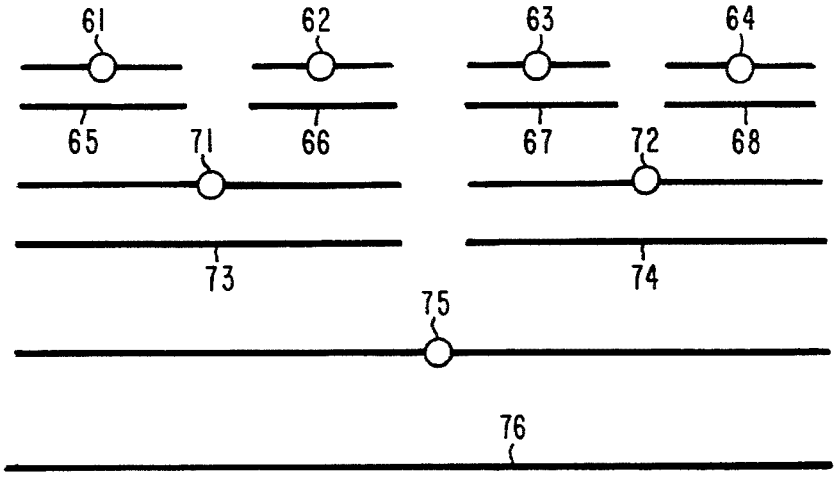
FIG. 4 shows an antenna similar to that of FIG. 3 which employs parasitic elements along with active elements.

FIG. 3 shows an embodiment using pairs of active or driven elements to form the arrays. Another embodiment shown in FIG. 4 uses parasitic elements along with active elements to form the multiple layer dipole arrays. Four C-band dipoles 61, 62, 63, 64 and four C-band parasitic reflector elements 65, 66, 67, 68 form the C-band dipole array. The dipoles 61, 62, 63, 64 are the driven elements, and the reflector elements 65, 66, 67, 68 are the parasitic elements. Similarly, two S-band dipoles 71, 72 and two S-band parasitic reflector elements 73, 74 form the S-band array. Finally, an L-band dipole 75 and an L-band parasitic reflector element 76 form the L-band array. This embodiment has the advantage of simplifying the feed packaging. The parasitic element is slightly longer than the active element and the separation between the active element and the parasitic element is generally less than ¼ wavelength.

FIG. 5 illustrates schematically an embodiment of a feedthrough lens 80 employing the principles of the present invention. This embodiment of the invention is also illustrated as being for use in three bands, which are here referred to as the high frequency band $f_1$, the medium-frequency band $f_2$, and the low-frequency band $f_3$. At the right side of the feedthrough lens 80 are three feed horns 81, 82, 83, the first horn 81 operating in the high frequency band $f_1$, the second horn 82 operating in the middle frequency band $f_2$, and the third horn 83 operating in the low frequency band $f_3$.

The outermost layer of the feedthrough lens 80 comprises the high-frequency pick-up arrays 84, of which eight are illustrated in FIG. 5. The next layer down of the feedthrough lens 80 comprises the medium-frequency pick-up arrays 85, of which four are shown in the figure. Finally, the innermost layer comprises the low-frequency pick-up array 86, of which two are illustrated.

On the left side of the feedthrough lens 80, the outermost layer of the array comprises eight high-band re-radiating arrays 87, the middle layer comprises four middle-frequency band re-radiating arrays 88, and the innermost layer comprises two low-band re-radiating arrays 90. Controllable phase shifter 91 may be inserted between the pick-up arrays 84, 85, 86 and the re-radiating arrays 87, 88, 90 for scanning the beams radiated from the feedthrough lens 80. The feedthrough lens 80 has the advantage of eliminating the need for corporate feed circuit boards because the feed horns 81, 82, 83 feed the arrays directly. However the feedthrough lens 80 does occupy more space.

Figure 6:
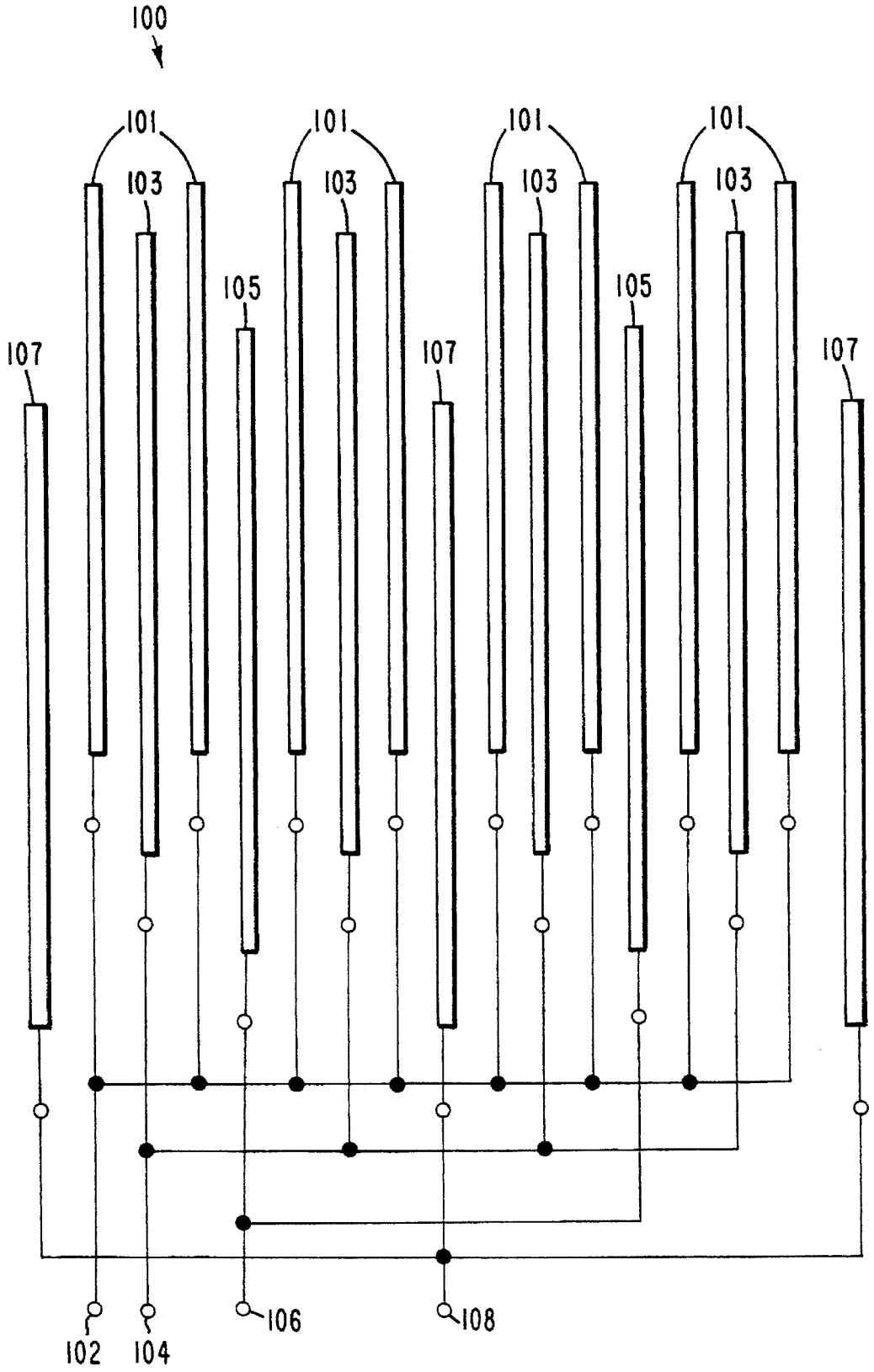
FIG. 6 shows a corporate feed for a multiple layer dipole array in accordance with the invention.

However, methods of reducing the required space to achieve a more compact antenna in accordance with the present invention have been provided. Referring now to FIG. 6, there is shown a corporate feed 100 for a multiple layer dipole array in accordance with the invention. This particular embodiment of a corporate feed 100 is for a four-band array that operates at X-band, C-band, S-band, and L-band. Eight X-band feed members 101 are interconnected and come out to a common X-band feed terminal 102. Four C-band feed members 103 are interconnected and come out to a common feed terminal 104. Two S-band feed members 105 are interconnected and come out to a common S-band feed terminal 106. Three L-band feed members 107 are interconnected and brought out to a common L-band feed terminal 108. This embodiment of a corporate feed 100 is packaged as a printed circuit board.

Referring now to FIG. 7 of the drawings, there is shown a perspective view of a dipole pair 110 employing strip transmission line feeds for the radiating elements. The upper dipole element 112 is fed by a printed circuit transmission line having a zero degree feed point 111 separated ¼ wavelength from a ninety degree feed point 117. The upper dipole element 112 is joined to a lower dipole element 115 which is also fed by a printed circuit transmission line having a zero degree feed point 118 separated ¼ wavelength from a ninety degree feed point 119. The feed points 117 and 119 are feeding the dipole elements 113 and 116 respectively. Thus, as may be seen, typical dipole pairs in accordance with the invention are fed in-phase by two wire transmission lines printed on each side of the feed circuit. For a separation of ¼ wavelength, the dipole pair will have an in-phase condition in the forward direction. The two elements are driven with a ninety degree phase difference to result in a forward radiation condition. A corporate feed power divider can be fabricated in an air stripline circuit or microstrip line circuit to feed these elements as shown in FIG. 6. The amplitude taper may be controlled to provide low side lobes.

The insertion loss due to the high frequency aperture being in front of the low frequency aperture is shown in Table 1. This is obtained by considering the transmission loss of a plane wave incident on the high frequency aperture. The operation frequency for the high frequency aperture is $f_1$=14.0 GHz. At the operating frequency $f_1$, all the power for an incident wave is absorbed and no energy is transmitted through the layer. Therefore, no high band energy will be coupled to the low band aperture. For an incident wave at lower frequencies, the transmission loss through the high frequency aperture is small. For example, the transmission loss at $f_2$=7.0 GHz is on the order of−1.43 dB which is mainly due to the absorption of the dipole loads in the high frequency aperture. Furthermore, the transmission loss is on the order of−0.26 dB at 3.5 GHz and on the order of −0.034 dB at 1.4 GHz, indicating the insertion loss due to the high frequency aperture is very small at the lower frequencies.

TABLE 1

| Freq. $f_2$ | P(Trans)/P(In) | Transmission Loss (dB) |
|---|---|---|
| 7.0 GHz | 0.72 | −1.43 dB |
| 3.5 GHz | 0.941 | −0.26 dB |
| 1.4 GHz | 0.9922 | −0.034 dB |

Thus there has been described a new and improved multi-frequency band, multi-layered, dipole array phased array antenna. The novel antenna of the present invention operates in different frequency bands. It provides good isolation between the high frequency band and the low frequency band, and it is compact and light in weight.

It is to be understood that the above-described embodiments are merely illustrative of some of the many specific embodiments which represent applications of the principles of the present invention. Clearly, numerous and other arrangements can be readily devised by those skilled in the art without departing from the scope of the invention.

What is claimed is:

1. A multi-frequency band array antenna for providing simultaneous operation over at least two frequency bands comprising:

a first array antenna including a plurality of first antenna array elements and having a first antenna aperture, said first antenna array elements being spaced apart from one another in a two dimensional array, said first antenna array elements being tuned to a first array operating frequency that is in a first frequency band, the spacing between said first antenna array elements being approximately half of the wavelength of said first array operating frequency;

a second array antenna including a plurality of second antenna array elements and having a second antenna aperture, said second antenna array elements being spaced apart from one another in a two dimensional array, said second antenna array elements being tuned to a second array operating frequency that is in a second frequency band, the spacing between said second antenna array elements being approximately half of the wavelength of said second array operating frequency; and a frequency selective ground plane screen interposed between said first array antenna and said second array antenna;

wherein said first frequency band is higher than said second frequency band and said first array antenna is positioned to receive incident radiation first, wherein said first array antenna is positioned above said second array antenna such that said first and second array antennas are spaced from each other by a predetermined distance, and wherein the number of first array elements is larger than the number of second antenna array elements.

2. The antenna of claim 1 wherein said first antenna array elements comprise dipole elements and said second antenna array elements comprise dipole elements, wherein orientation of the dipoles in the first antenna array and the second antenna array is selected to reduce cross coupling between said first and second frequency bands.

3. The antenna of claim 2 wherein said dipole elements in said first array antenna are positioned parallel to one another and said dipole elements in said second array antenna are positioned parallel to one another and perpendicular to said dipole elements in said first array antenna.

4. The antenna of claim 2 wherein the length of the dipole elements in said first and second array antennas is selected to reduce cross coupling between said first and second frequency bands.

5. A multi-frequency band phased array antenna for providing simultaneous operation over at least two frequency bands comprising:

a first array antenna including a plurality of first antenna array elements and having a first antenna aperture, said first antenna array elements being spaced apart from one another in a two dimensional array, said first antenna array elements being tuned to a first array operating frequency that is in a first frequency band, the spacing between said first antenna array elements being approximately half of the wavelength of said first array operating frequency;

a second array antenna including a plurality of second antenna array elements and having a second antenna aperture, said second antenna array elements being spaced apart from one another in a two dimensional array, said second antenna array elements being tuned to a second array operating frequency that is in a second frequency band, the spacing between said second antenna array elements being approximately half of the wavelength of said second array operating frequency;

wherein said first frequency band is higher than said second frequency band and said fist array antenna is positioned to receive incident radiation first, wherein said first array antenna is positioned above said second array antenna such that said first and second antenna arrays are spaced from each other by a predetermined distance, and wherein the number of first array elements is larger than the number of second antenna array element, wherein said first array antenna array elements comprise pairs of active and reflective parasitic elements and wherein said second array antenna array elements comprise pairs of active and reflective parasitic elements;

a first plurality of electronic phase shifters coupled individually to said first antenna array elements; and a second plurality of electronic phase shifters coupled individually to said second antenna array elements.

6. A multi-frequency band array antenna for providing simultaneous operation over at least two frequency bands comprising:

a first array antenna including a plurality of first antenna array elements and having a first antenna aperture, said first antenna array elements being spaced apart from one another in a two dimensional array, said first antenna array elements being tuned to a first array operating frequency that is in a first frequency band, the spacing between said first antenna array elements being approximately half of the wavelength of said first array operating frequency;

a second array antenna including a plurality of second antenna array elements and having a second antenna aperture, said second antenna array elements being spaced apart from one another in a two dimensional array, said second antenna array elements being tuned to a second array operating frequency that is in a second frequency band, the spacing between said second antenna array elements being approximately half of the wavelength of said second array operating frequency;

wherein said first frequency band is higher than said second frequency band and said first array antenna is positioned to receive incident radiation first, wherein said first array antenna is positioned above said second array antenna such that said first and second array antennas are spaced from each other by a predetermined distance, and wherein the number of first array elements is larger than the number of second antenna array elements, and wherein said first array antenna comprises first and second layers, each of said first and second layers including the same number of first antenna array elements such that individual elements of said first layer form pairs with individual elements of said second layer; and means for driving said elements of said first layer, whereby said elements of said first layer are directly driven and said elements of said second layer operate as reflectors.

7. The antenna of claim 6 further comprising a constrained feed coupled to said first antenna array for processing said first frequency band.

8. A multiple frequency band feedthrough lens comprising:

a first pickup array antenna including a plurality of first pickup antenna array elements, said first pickup antenna array elements being spaced apart from one another in a two dimensional array, said first pickup antenna array elements being tuned to operate in a first frequency band;

a second pickup array antenna including a plurality of second pickup antenna array elements, said second pickup antenna array elements being spaced apart from one another in a two dimensional array, said second pickup antenna array elements being tuned to operate in a second frequency band that is lower than said first frequency band, said second pickup array being located above said first pickup array antenna such that second pickup array antenna is spaced from said first pickup array antenna by a first predetermined distance;

a third pickup array antenna including a plurality of third pickup antenna array elements, said third pickup antenna array elements being spaced apart from one another in a two dimensional array, said third pickup antenna array elements being tuned to operate in a third frequency band that is lower than said second frequency band, said third pickup array being located above said second pickup array antenna such that said third pickup array antenna is spaced from said second pickup array antenna by a second predetermined distance;

a first re-radiating array antenna including a plurality of first re-radiating antenna array elements that correspond in number to the plurality of first pickup antenna array elements, said first re-radiating antenna array elements being spaced apart from one another in a two dimensional array, said first re-radiating antenna array elements being tuned to operate in the first frequency band, said first re-radiating array antenna being located above said third pickup array antenna, and said first re-radiating antenna array elements being positioned above corresponding first pickup antenna array elements;

a second re-radiating array antenna including a plurality of second re-radiating antenna array elements that correspond in number to said second pickup array antenna elements, said second re-radiating antenna array elements being spaced apart from one another in a two dimensional array, said second re-radiating antenna array elements being tuned to operate in the second frequency band, said second re-radiating array being located below said first re-radiating array antenna and above said third pickup array antenna such that second re-radiating array antenna is spaced from said first re-radiating array antenna by said first predetermined distance, said second re-radiating antenna array elements being positioned above corresponding second pickup antenna array elements; and a third re-radiating array antenna including a plurality of third re-radiating antenna array elements that correspond in number to the third pickup array antenna elements, said third re-radiating antenna array elements being spaced apart from one another in a two dimensional array, said third re-radiating antenna array elements being tuned to operate in the third frequency band, said third re-radiating array antenna being located below said second re-radiating array antenna and above said third pickup array antenna such that said third re-radiating array antenna is spaced from said second re-radiating array antenna by the second predetermined distance, said third re-radiating antenna array elements being positioned above corresponding third pickup antenna array elements.

9. The feedthrough lens of claim 8 further including feed horns.

* * * * *